United States Patent [19]

Kanno et al.

[11] Patent Number: 4,643,617

[45] Date of Patent: Feb. 17, 1987

[54] METHOD OF CREATING OFFSHORE SEABED MOUND

[75] Inventors: Haruki Kanno; Hidekazu Tsuyoshi; Kou Nishinakagawa; Makoto Hara; Tetsuo Mochida; Tsugio Hisaka; Munekazu Miyaki; Minoru Kawarada, all of Tokyo; Hideaki Kawarabayashi, Kashiwa, all of Japan

[73] Assignee: Takenaka Kohmuten Co., Lt., Osaka, Japan

[21] Appl. No.: 731,889

[22] Filed: May 8, 1985

[30] Foreign Application Priority Data

May 14, 1984 [JP] Japan ..... 58-96199

[51] Int. Cl.[4] ..... E02D 3/00; E02D 3/12

[52] U.S. Cl. ..... 405/222; 405/267; 405/11

[58] Field of Search ..... 405/217, 222, 223, 11, 405/14, 266, 267

[56] References Cited

U.S. PATENT DOCUMENTS

| | | | |
|---|---|---|---|
| 416,180 | 12/1889 | Neukirch | 405/266 |
| 1,624,330 | 4/1927 | Gerwick | 405/222 |
| 2,782,605 | 2/1957 | Wertz et al. | 405/266 |
| 3,023,585 | 3/1962 | Liver | 405/266 |
| 3,861,157 | 1/1975 | Hillen | 405/223 |
| 3,871,181 | 3/1975 | DeLong | 405/11 |
| 4,065,933 | 1/1978 | Katayama | 405/223 |
| 4,072,017 | 2/1978 | Shiraki | 405/269 |
| 4,089,183 | 5/1978 | Endo et al. | 405/267 |

FOREIGN PATENT DOCUMENTS 199484 11/1984 Japan .

*Primary Examiner*—Richard J. Scanlan, Jr.
*Assistant Examiner*—Kristina I. Hall
*Attorney, Agent, or Firm*—Vorys, Sater, Seymour & Pease

[57] ABSTRACT

A seabed mound creating method suitable for a construction of a large scale offshore structure comprises the steps of setting up a plurality of sheet piles along the outer periphery of a mound creation region in a seabed area of soft ground to form an earth-retaining wall projecting from the seabed, and raising the ground level of the seabed within the earth-retaining wall by depositing soft soil into the earth-retaining wall to heap the deposited soil to a predetermined height. The method further comprises the step of implementing a ground improvement process to both the heaped-up soft soil and the soft ground of the seabed within the earth-retaining wall so that the ground improvement process is provided to a predetermined depth below the seabed, thus to form a seabed mound integral with the improved ground. The seabed mound may be provided at the upper portion with a projection area serving as a shear key with respect to a horizontal external force. Such a seabed mound can eliminate difficulty in supplying mound materials even when constructing a structure in an offshore area. When the ground improvement process is equally implemented to both a seabed ground and the heaped up soft soil, the seabed integrally formed with the improved ground can be created. Thus, a great shear strength due to such an integral structure can resist a horizontal external force, thereby ensuring high security.

19 Claims, 7 Drawing Figures

METHOD OF CREATING OFFSHORE SEABED MOUND

BACKGROUND OF THE INVENTION

The present invention relates to a seabed mound creation method in the technology for constructing a gravity-type large offshore structure on a soft ground in a shallow sea area where the depth of water is about 10 to 30 m, and more particularly to an improved method of creating a seabed mound having a high stability to the ground in an offshore or an ocean area where supply of mound materials is difficult.

When constructing a gravity-type offshore structure, the shallower the base position is, the more economical the structure is. For this reason, creation of seabed mounds is ordinarily carried out. In most cases, such mounds are formed by heaping up mound materials e.g., riprap or sands and so forth on the seabed.

However, when the seabed consists of soft or weak ground, mound materials cannot be heaped up thereon without taking additional measures. To overcome this, in the prior art, there has been employed a method as disclosed in Japanese patent application No. 58-69878, wherein the method comprises the steps of improving the soft ground on a seabed, heaping up sands and rocks on the improved ground to form a seabed mound, and setting up a structure on the seabed mound thus formed.

For this reason, construction of the mound must be executed in two working steps for ground improvement of the seabed and for the mound construction, resulting in a large number of working steps and prolonged term of construction. Further, it takes much time to construct a mound and increase the cost of transport in an offshore or an ocean area where the supply of mound materials is limited.

Meanwhile, when an offshore structure is constructed in a sea area where an earthquake is likely to happen, in which there exists the strong influence of a seismic force as an external force, or in a sea area where there exists the strong influence of an external force due to waves or tides, a considerably large horizontal external force acts on the offshore structure. On the other hand, so called friction-type structures are constructed so as to remove the horizontal external force by making use of the frictonal resistance force between the improved ground and the mound materials heaped up thereon and the frictional resistance force between the mound and the offshore structure. However, with such friction-type structures, it is quite difficult to ensure a safety factor of the recent design standard.

Namely, in the case of the gravity-type offshore structure, the study of the stability between the mound and the structure will be made based on the following equation, $$F_S = W' \mu / F_H > F_{SO},$$

where $F_S$ is a safety factor, W' is a weight when buoyancy is taken into account, $\mu$ is a friction coefficient, $F_H$ is a horizontal external force, and $F_{SO}$ is a specified safety factor.

As is clear from the above equation, if a horizontal external forth $F_H$ due to an earthquake is excessive, the resistance due to the friction coefficient $\mu$ is limited. In many cases, this makes it difficult to guarantee a sufficiently large safety factor $F_S$.

SUMMARY OF THE INVENTION

With the above in mind, an object of the present invention is to provide a creation method for an offshore seabed mound wherein there is not any difficulty in supplying mound materials even when constructing a structure in an offshore or ocean area.

Another object of the present invention is to make it possible to create an offshore seabed mound by using a simplified process such that a ground improvement process is equally implemented to the ground and the mound material is formed on heaped-up ground.

A further object of the present invention is to provide a creation method for an offshore seabed mound wherein a large shear strength obtained by integrally forming the improved ground and the mound can resist a horizontal external force, thus making it possible to easily guarantee a high security.

To achieve these objects, there is provided a method of creating an offshore seabed mound comprising the steps of: setting up partition means at least along an outer periphery of a region where a mound is to be created in a seabed area of soft ground to form an earth-retaining wall projecting from the seabed; raising the ground level of the seabed within the earth-retaining wall by depositing soft soil into the earth-retaining wall to heap the deposited soil to a predetermined height, and implementing a ground improvement process to both the heaped-up soft soil and the soft ground of the seabed within the earth-retaining wall so that the ground improvement process is executed to a predetermined depth below the seabed.

The partition means may comprise a plurality of sheet piles joined to each other, their bottoms being embedded in the seabed. The earth-retaining wall may be circular-shaped. The earth-retaining wall may be formed by piling the seabed along the outer periphery of the mound creation region using a plurality of sheet piles, and winding a plurality of binding members along the outer circumferential surface of the sheet piles above the seabed.

The soft soil for raising the ground level of the seabed may be collected from the seabed around the earth-retaining wall.

The ground improvement process may be carried out by a grouting and blending apparatus. The ground improvement process may comprise the steps of grouting a cement slurry into the soft soil and soft ground, blending the cement slurry in the soft soil and soft ground, and solidifying it to form a mound integral with the improved ground.

An upper structure can rest on the mound. The created mound may be provided at the upper portion thereof with a projection area serving as a shear key with respect to a horizontal external force.

The partition member may be set up along the outer periphery of the projection area. The upper structure may rest over at least the projection area of the mound.

The ground improvement process may be implemented not only to the soft ground of the projection area within the earth-retaining wall, but also to the soft ground outside the earth-retaining wall in a mound area where the upper structure rests. A cement grout may be grouted between the upper structure and the mound.

BRIEF DESCRIPTION OF THE DRAWINGS

The features and advantages of an offshore seabed mound creation method according to the present invention will become more apparent from the following description taken in conjunction with the accompanying drawings, in which.

FIGS. IA, IB, 2, 3 and 4 are schematic views illustrating working procedures of an embodiment of an offshore seabed mound creation method according to the present invention, respectively.

DETAILED DESCRIPTION OF THE PREFERRED EMBODIMENTS

Preferred embodiments of a seabed mound creation method according to the present invention will be described with reference to the attached drawings.

First embodiment

Figure 5:
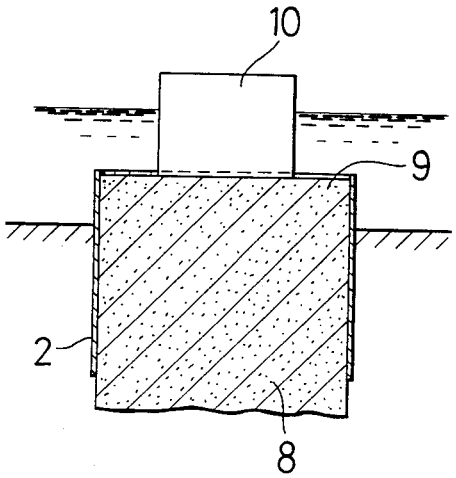
FIG. 5 is a longitudinal cross sectional view schematically illustrating a finished ocean structure wherein an upper structure rests on the mound constructed by the method of the embodiment shown in FIG. 1.

FIGS. 1 to 4 are schematic views illustrating working procedures for executing the seabed mound creation method according to the first embodiment, respectively, and FIG. 5 is a cross sectional view illustrating a finished ocean structure.

Figure 1A:
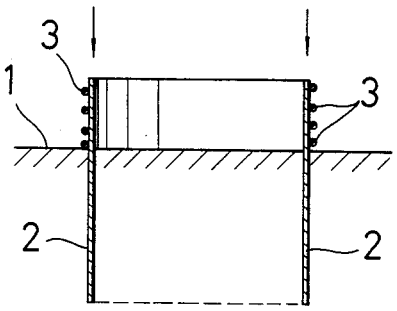
Figure 1B:
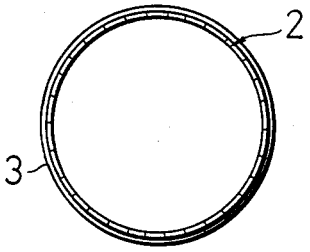

Initially, a weak ground seabed 1 of a sea area where a structure is to be constructed is piled by using earth-retaining members 2 e.g. steel sheet piles to a depth such that the structure stands by itself with the retaining members 2 being arranged so as to form an outer periphery of a mound creation region. These earth-retaining members 2 constitute partition means. Then, binding members 3 are wound onto the outer peripheries of portions above the seabed of the earth-retaining members 2 to build an earth-retaining wall or mold for filling with earth (FIGS. 1A and 1B). It is to be noted that the circular-shaped earth-retaining wall is shown only for illustrative purpose, and therefore other shapes may be employed.

Figure 2:
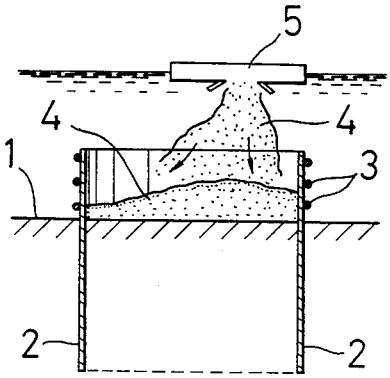

Subsequently, soft soil 4 is collected from the seabed around the earth-retaining wall. The soft soil thus collected is transported by a barge 5 to deposit it within the wall constituted by the earth-retaining members 2, thus raising the ground level to a height required for a mound on the seabed 1, as best seen in FIG. 2.

Figure 3:
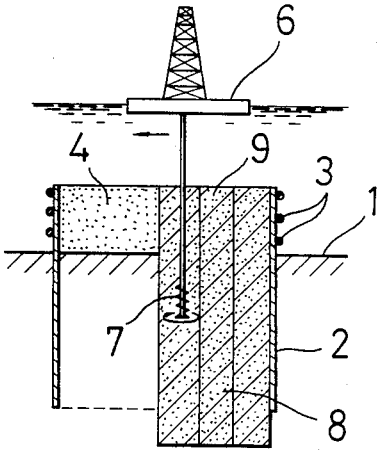
Figure 4:
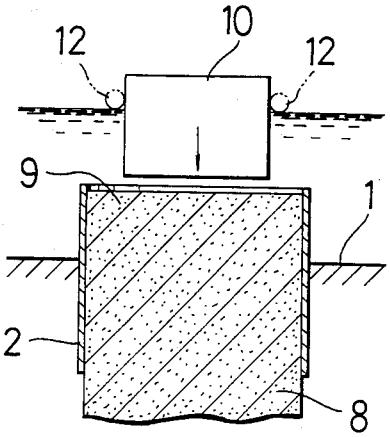

Then, by using a grouting and blending apparatus 7 suspended downwardly from a barge 6 on the surface of the sea, a ground improvement process is equally implemented to the heaped-up soft soil 4 and the soft ground of the seabed ground 1 therebelow. For instance, the ground improvement process, e.g., a deep mixing process, comprises the steps of grouting a cement slurry essentially consisting of material of cement system into the soft soil and soft ground, blending the cement slurry in the soft soil and soft ground, and thereafter solidfying it, thus forming a mound 9 integral with an improved ground 8, as shown in FIG. 3. The depth to be ground-improved is about 30 m below the seabed 1, e.g. in Tokyo bay, although it depends on the depth of the soft ground.

Then, by sinking an upper structure 10 to the upper end of the seabed mound 9 thus formed and fixed thereon, construction of the gravity-type, bottom-sitting type offshore structure is completed, as seen in FIG. 5. Reference numeral 12 denotes floats.

In the structure thus constructed, the seabed mound 9 and the improved ground 8 are integral with each other as an improved earth. Accordingly, a large shear strength due to the improved ground 8 and the seabed mound 9 can resist a horizontal external force, thus ensuring great horizontal resistance force and a high safety factor.

Second embodiment

Figure 6:
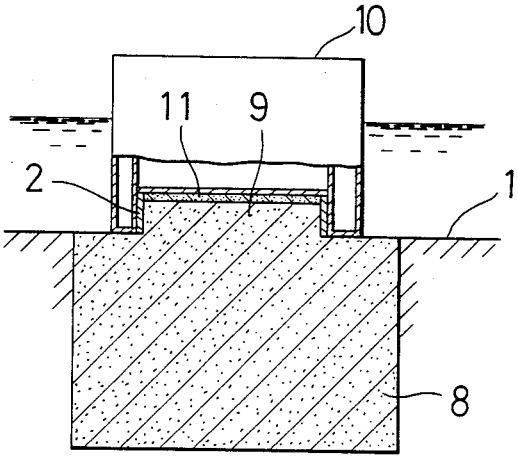
FIG. 6 is a longitudinal cross sectional view schematically illustrating an ocean structure wherein an upper structure rests on the mound constructed by another embodiment of an offshore seabed mound creation method according to the present invention.

FIG. 6 is a configuration in the case where resistance force with respect to a horizontal external force in connection with the relationship between the upper structure 10 and the improved ground 8 and between the upper structure 10 and the seabed mound 9 is attained by shear strength of the improved ground.

This embodiment has a first working step similar to that in the first embodiment. Namely, the first working step is to build a circular wall by means of earth-retaining members 2 around the outer periphery of a region where the seabed mound 9 is to be created and to deposit soft soil into the wall to raise the ground level of the seabed within the earth-retaining wall.

This embodiment is characterized in that the ground improvement process is implemented not only to the inside of the wall encircled by the earth-retaining members 2 but also to the outside therof over a desired area. In a manner similar to the first embodiment, in this embodiment, the ground improvement process is also implemented equally to the heaped-up ground thrown into the wall encircled by the earth-retaining members and the seabed ground 1, thus to form a seabed mound 9 integral with the improved ground 8.

Further, an upper structure 10 directly rests at its bottom on the seabed ground 8 around the outer perihery of the seabed mound 9. In other words, the ground improvement process outside the wall encircled by the earth-retaining members 2 is implemented to an extent where at least the bottom of the upper structure 10 sits thereon. Further, a cement grout is grouted into gaps 11 between the upper structure 10 and the seabed mound 9 so that they are integral with each other.

Accordingly, the resistance with respect to a horizontal external force in the relationship between the upper structure 10 and the improved ground 8 and between the upper structure 10 and the seabed mound 9 is retained by shear strength of the seabed mound 9 serving as a shear key, thus ensuring a large safety factor.

Other embodiment

In the above-mentioned second embodiment, the method is executed so that the entire seabed mound 9 serves as a shear key, but the present invention is not limited to such an embodiment. For example, a projection area serving as a shear key may be on the upper central portion of the mound shown in FIG. 5.

Advantages with the present invention

As appreciated from the foregoing description, the present invention can provide advantages as follows.

(i) Soft soil collected from a neighboring seabed is are used as end materials. Accordingly, there is no need to supply mound materials e.g. sands, ripraps, and pebbles to. To transport them to a remote place. Accordingly, this reduces the expenses related to the mound materials to a great extent. Thus, the method of the invention is suitable for construction in an offshore area where the supply of mound materials is limited.

(ii) The ground improvement process is carried out at a stroke from the top of the heaped-up ground to a desired depth of the seabed ground, resulting in no troublesomeness in execution of work and in a small number of steps. This enables rationalization of the working step and a shortened term of work.

(iii) In accordance with the above-mentioned ground improvement process, the mound integrally formed with the improved ground is constructed, thus making it possible to exhibit a large shear strength of the improved earth as a resistance element. Accordingly, this enables a horizontal resistance force between the mound and the ground to be large, thus ensuring a high security required for offshore structures to which rigorous design requirements are imposed.

The stability of the mound and the ground created with the method according to the present invention is evaluated by the following equation, $$F_S = \tau_f S / F_H$$

where $\tau_f$ is a shear strength of the improved ground and S is a shear area. Ordinarily, the shear strength and of the improved earth based on the deep mixing method is expressed as $(\frac{1}{2}-\frac{1}{3})q_u$, where $q_u$ is an unconfined compression strength of 50 to 60 kg/cm2. The larger the mound scale (shear area S) is, the higher the safety factor is. It is obvious that the method of the invention is superior to the conventional friction-type method.

What is claimed is:

1. A method of creating an offshore seabed mound at a mound creation location on a seabed by using a barge on the surface of the sea, comprising the steps of:

(a) setting up partition means from said barge at least along an outer periphery of a region on the seabed where a mound is to be created in a seabed area of soft ground to form an earth-retaining wall around said region projecting from the seabed by a predetermined mound height, (b) raising the ground level of said seabed within said earth-retaining wall by depositing soft soil collected from the seabed at an area around said wall into said region with said earth-retaining wall from said barge to heap the deposited soil within the wall to said predetermined mound height, and (c) implementing a ground improvement process comprising a mixing and blending operation carried out by a grouting and blending apparatus to both said heaped-up soft soil and said soft ground of said seabed within said earth-retaining wall so that said ground improvement process is executed to a predetermined depth below said seabed.

2. A method of creating an offshore seabed mound as set forth in claim 1, wherein said partition means comprises a plurality of sheets piles joined to each other, their button portions being embedded in said seabed.

3. A method of creating an offshore seabed mound as set forth in claim 1, wherein said earth-retaining wall is circular-shaped.

4. A method of creating an offshore seabed mound as set forth in claim 2, wherein said earth-retaining wall is formed by piling a plurality of sheet piles into said seabed along the outer periphery of the mound creation region, and winding a plurality of binding members along the outer circumferential surface of said sheet piles above said seabed.

5. A method of creating an offshore seabed mound as set forth in claim 1, wherein said ground improvement process comprises the steps of grouting a cement slurry into said soft soil and said soft ground, blending said cement slurry in said soft soil and soft ground, and solidifying it to form a mound integral with the improved ground.

6. A method of creating an offshore seabed mound as set forth in claim 5, wherein an upper structure rests on said mound.

7. A method of creating an offshore seabed mound as set forth in claim 1, wherein the created mound is provided at the upper portion thereof with a projection area serving as a shear key with respect to a horizontal external force.

8. A method of creating an offshore seabed mound as set forth in claim 6, wherein said partition means is set up along the outer periphery of a projection area of said mound.

9. A method of creating an offshore seabed mound as set forth in claim 8, wherein an upper structure rests over at least said projection area of said mound.

10. A method of creating an offshore seabed mound as set forth in claim 9, wherein said ground improvement process is implemented not only to the soft ground of said projection area within said earth-retaining wall, but also to the soft ground outside said earth-retaining wall at least in a mound area where said upper structure sits on.

11. A method of creating an offshore seabed mound as set forth in claim 10, wherein a cement grout is grouted between said upper structure and said mound.

12. A method of creating an offshore seabed mound comprising the steps of:

(a) setting up a partition wall from a barge on the sea along an outer periphery of a region where a mound is to be created in an offshore seabed of soft ground to form an earth-retaining wall around said region projecting from said seabed by a desired mound height, (b) carrying soft soil collected from an area around said earth-retaining wall using said barge on the sea to deposit said soft soil into said region within said earth-retaining wall from said barge on the sea to heap the deposited soil on said seabed mound to said desired mound height, and (c) applying a mixing and blending operation by a mixing and grouting device, from said barge on the sea, both to the heaped-up portion within said earth-retaining wall and to a portion of said seabed ground below said heaped-up portion so that ground improvement process is successively implemented to said both portions to a predetermined depth from the seabed level.

13. A method of creating an offshore seabed mound as set forth in claim 12, wherein said earth-retaining wall is formed by piling a plurality of sheet piles along the outer periphery of the mound creation region of said seabed mound from said barge on the sea so that said sheet piles are joined to each other.

14. A method of creating an offshore seabed mound as set forth in claim 12, wherein an upper structure rests on the created mound, a portion of said structure being projected from the sea.

15. A method of creating an offshore seabed mound as set forth in claim 13, wherein an upper structure rests on the created mound, a portion of said structure being projected from the sea.

16. A method of creating an offshore seabed mound as set forth in claim 14, wherein said created mound is provided at the upper portion thereof with a projection area serving as a shear key with respect to a horizontal external force, an upper structure being provided at its bottom portion with a recessed portion into which said projection area is fitted, said upper structure being adapted to rest on the upper portion of said created mound.

17. A method of creating an offshore seabed mound as set forth in claim 15, wherein said earth-retaining wall is formed by piling a plurality of sheet piles into said seabed along the outer periphery of the mound creation region, and winding a plurality of binding members along the outer circumferential surface of said sheet piles.

18. A method of creating an offshore seabed mound as set forth in claim 16, wherein said earth-retaining wall is set up only along the outer periphery of said projection area.

19. A method of creating an offshore seabed mound as set forth in claim 17, wherein said earth-retaining wall is set up only along the outer periphery of said projection area.

* * * * *